US007651442B2

(12) United States Patent
Carlson

(10) Patent No.: US 7,651,442 B2
(45) Date of Patent: Jan. 26, 2010

(54) UNIVERSAL SYSTEM FOR MONITORING AND CONTROLLING EXERCISE PARAMETERS

(76) Inventor: Alan Carlson, 6202 Lynn La., Lago Vista, TX (US) 78645

( * ) Notice: Subject to any disclaimer, the term of this patent is extended or adjusted under 35 U.S.C. 154(b) by 188 days.

(21) Appl. No.: 10/794,234

(22) Filed: Mar. 5, 2004

(65) Prior Publication Data

US 2004/0176226 A1 Sep. 9, 2004

Related U.S. Application Data

(63) Continuation-in-part of application No. 10/367,395, filed on Feb. 14, 2003, and a continuation-in-part of application No. 10/219,976, filed on Aug. 15, 2002, now Pat. No. 7,104,926.

(60) Provisional application No. 60/452,158, filed on Mar. 5, 2003.

(51) Int. Cl.
*A63B 71/00* (2006.01)

(52) U.S. Cl. ..... 482/8; 482/1; 482/9

(58) Field of Classification Search ..... 482/1–9, 482/900–902; 434/247; 600/300
See application file for complete search history.

(56) References Cited

U.S. PATENT DOCUMENTS 4,534,557 A * 8/1985 Bigelow et al. ..... 473/442
5,529,552 A * 6/1996 Biedermann et al. ..... 482/51
5,989,157 A * 11/1999 Walton ..... 482/4
5,997,440 A * 12/1999 Hanoun ..... 482/10
6,027,429 A * 2/2000 Daniels ..... 482/5
6,059,576 A * 5/2000 Brann ..... 434/247
6,066,075 A * 5/2000 Poulton ..... 482/8
6,280,361 B1 * 8/2001 Harvey et al. ..... 482/8
6,454,681 B1 * 9/2002 Brassil et al. ..... 482/49
6,514,199 B1 * 2/2003 Alessandri ..... 600/300
6,554,749 B2 * 4/2003 Iund et al. ..... 482/54
6,669,600 B2 * 12/2003 Warner ..... 482/8
6,921,351 B1 * 7/2005 Hickman et al. ..... 482/8
7,121,982 B2 * 10/2006 Feldman ..... 482/8

* cited by examiner

*Primary Examiner*—Glenn Richman
(74) *Attorney, Agent, or Firm*—Alan L. Carlson

(57) ABSTRACT

A universal system for monitoring activities and motions during exercise and controlling the resistance provided to a user of exercise equipment during the motions. The system having at least one sensor to detect at least one of physical parameter of the exercisers activity such as force, acceleration, and/or direction of user movements. The resistance mechanism provides an adjustable and variable resistance and a dampened response to an exerciser while the sensors monitor the forces and resulting movement of the user interface. The system provides an adjustable resistance system for exercising parts of the body having complex movements over a full range of motion such as the arms, legs, neck, wrist, ankle, and torso. The present invention is also adaptable to existing fitness equipment. The system can also provide effective resistance and damping over the range of motion in free space. The force exerted by the user on the user interface can be measured over the entire range of motion using force and position sensors.

31 Claims, 2 Drawing Sheets

UNIVERSAL SYSTEM FOR MONITORING AND CONTROLLING EXERCISE PARAMETERS

RELATED APPLICATIONS

This application is based on a provisional application No. 60/452,158 entitled Resistance Mechanism For Physical Fitness Equipment filed on Mar. 5, 2003 and this application is a continuation-in part of co-pending and commonly assigned patent application entitled Exercising Machine for Working Muscles the Support the Spine. Ser. No. 10/219,976 filed Aug. 15, 2002 now U.S. Pat. No. 7,104,926, and this application is a continuation in part of co-pending and commonly assigned patent application entitled Exercise Apparatus Having a User Interface Which Can Move Arcuately in Three Dimensions, Ser. No. 10/367,395 filed on Feb. 14, 2003.

FIELD OF THE INVENTION

This invention relates to fitness and rehabilitation equipment for humans and more specifically to a universal monitoring system for fitness equipment that provides a wide range of measurement, control resistance and damping regarding user movements. The invention further relates to a monitoring system that can monitor forces occurring in three-dimensional motion and a resistance system that can provide a controlled and measurable resistance and damping to a user of exercise equipment.

BACKGROUND OF THE INVENTION

Exercise and rehabilitation has become an important part of life for many. It has been proven that exercise can increase longevity, rehabilitate injuries, prevent injuries, improve athletic performance, and can improve the way of life for many. Most exercise equipment cannot measure or monitor range of motion, strength, flexibility and fatigue of the exerciser and record useful data. However, exercise data can be very valuable for exercisers or users, therapists and doctors. Additionally, current exercise apparatuses do not provide an effective multidirectional safely loaded movement wherein the forces and other physical properties can be controlled while performance is measured over a broad range of motion. There are many shortcomings in evaluating athletic movements and performance during non-traditional motions and movements and positions. Current exercise methods and apparatuses provide limited monitoring for the exerciser and do not have a way to measure force, distance, direction and acceleration provided by the exerciser over a full range of motion which is safely loaded. The deficiencies above are particularly prevalent in exercise equipment for body parts which have rotational movements (as opposed to hinge movements) such as the neck, wrist, lower back, shoulder, etc. Many joints such as the wrist and ankle bend, pronate and rotate and current exercise machines cannot detect the path or rotation of the users movements. Although humans can move most joints 360 degrees, certain areas or ranges of movement are weak and too much load at a particular location and in a particular direction can tear connective tissue such as muscles ligaments and tendons. Thus, controlling the resistance of the load, the acceleration and velocity of the user interface while detecting the amount and direction of the force during the exercise has here-to-fore been unachievable.

SUMMARY

A universal system for monitoring activities and motions during exercise and controlling the resistance provided to a user of exercise equipment during the motions. The system having at least one sensor to detect at least one of physical parameter of the exercisers activity such as force, acceleration, and/or direction of user movements. The resistance mechanism provides an adjustable and variable resistance and a dampened response to an exerciser while the sensors monitor the forces and resulting movement of the user interface. The system provides an adjustable resistance system for exercising parts of the body having complex movements over a full range of motion such as the arms, legs, neck, wrist, ankle, and torso. The present invention is also adaptable to existing fitness equipment. The system can also provide effective resistance and damping over the range of motion in free space. The force exerted by the user on the user interface can be measured over the entire range of motion using force and position sensors.

DETAILED DESCRIPTION

A universal system for monitoring and controlling parameters of exercise equipment and for providing user feedback regarding the exercisers movements. The system has at least one sensor to detect at least one of physical parameter of an exerciser's activity such as force, acceleration, direction, velocity, and movement of a portion of a user body. The sensors can be coupled to a user interface or to a resistance mechanism wherein the resistance mechanism provides an adjustable and variable resistance and damping to the exerciser while the sensors monitor user input such as forces and movement of the user interface.

Figure 1:
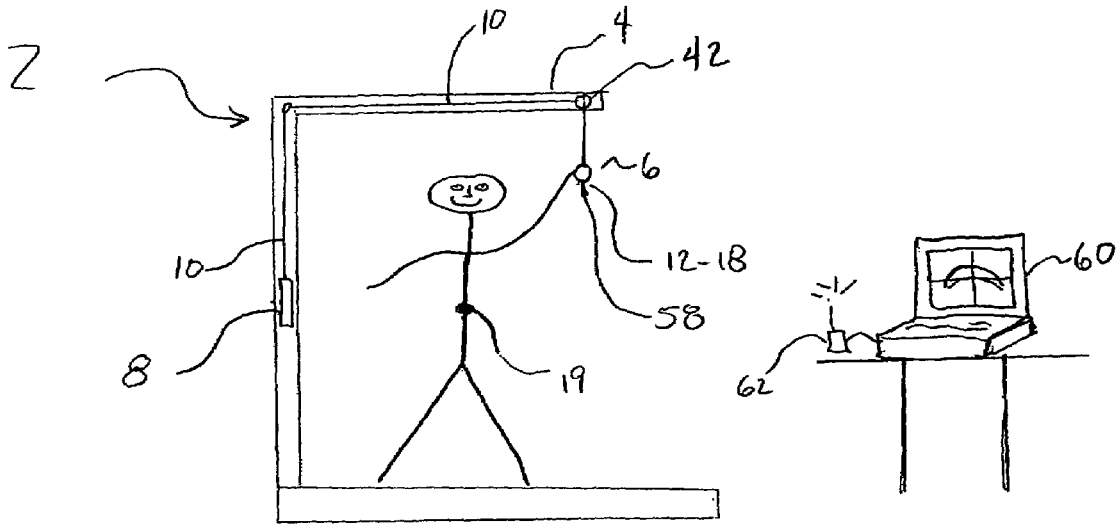
FIG. 1 illustrates an example of an exercise apparatus for human use.

Referring to FIG. 1, an exemplary exercise device 2 is depicted. Exercise device 2 can have a frame 4, at least one user interface 6 connected to a resistance system 8 using a lead 10. The exerciser grasps or pushes on a user interface 6 pulling the lead 10 and movement of the lead is impeded by the resistance system 8. Lead 20, can be a cord, a cable a band a rope a polymer or any flexible material. A rope made of Kevlar™ could be used. Lead 20 can be placed in and around pulleys 42 and fairleads to accommodate different orientations between the user interface 6 and the resistance system 8. Resistance system 8 could be weights, elastic bands and/or springs (not shown) however, a hydraulic system is described below. Resistance system 8 can provide an adjustable and variable resistance and damping to an exercisers movements. The user interface 6 can contain sensors 12-18. It is also possible to connect additional sensors 12-18 to the resistance system 8

Figure 2:
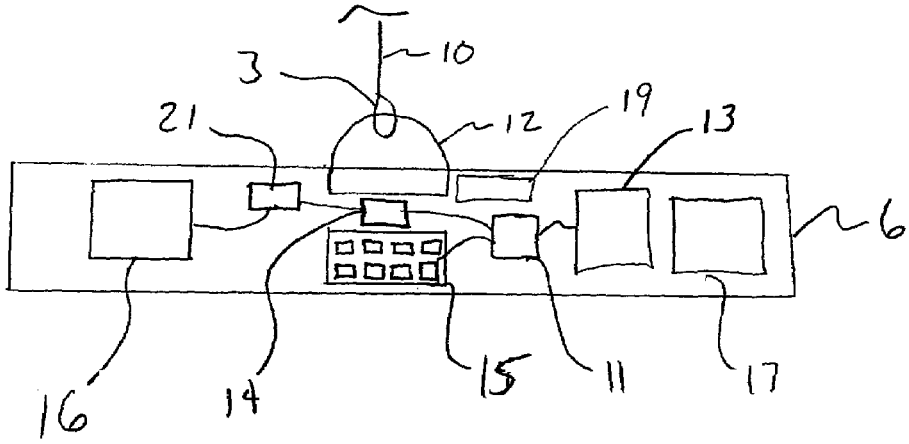
FIG. 2 depicts one embodiment of a universal user interface having sensors for monitoring parameters of an exercisers activity.

Referring briefly to FIG. 2, an exemplary user interface 6 is depicted. Sensors 12-18 are mounted within the user interface 6 to receive user input such as numeric input and sense changes in the orientation of the user interface 6 responsive to a users input. More particularly, changes in the orientation of the user interface could be distance traveled, rotation, direction moved, forces applied, fluidity of motion, acceleration, velocity, and path traveled. Time lapsed data can calculate work calorie burn fatigue rate and other parameters. User input could also be physical parameters of the exerciser such as heart rate, body temperature, grip strength, and other parameters.

Referring back to FIG. 1 transmitter 58 is coupled to the at least one sensors 12-18 and is capable of transmitting sensor data to a receiver 62 which can plug into a port on computer 60. Computer 60 can collect data, process data, display data real time and create web pages for transmission over the Internet (not shown) to other computers. Computer 60 can also analyze and compare a suggested exercise routine with a routine that is in process. The suggested exercise routine can be prescribed by a specialist such as a medical doctor, a physical therapist a trainer or a chiropractor. Sensors 12-18 can provide real time feedback regarding the quality of the movements based ion the suggested routine. Computer 60 can provide real time data and display suggested movements or motion for the user to perform or whether the exerciser is using proper form. Computer 60 can receive and process data and use various sensor data to provide useable data graphs, charts explanations and other info about the users routine to the medical professional who suggested the routine. More particularly the sensors 12-18 can determine the motion of the user and computer 60 can provide real time feedback and inform the user to change something about the way he/she is exercising or to stop work it the exerciser is over exerting himself or if harm may be imminent. Computer 60 can also compile data from many exercise or therapy secessions and analyze the data to determine if therapy, rehabilitation or exercise is improving a users performance. Computer 60 can receive sensor data and control the resistance provided by the resistance system 8 in accordance with the users ability. A safety feature can be built into the system wherein when a users grip on the user interface is relaxed the first and second valves on the resistance system close reducing the load to the user thus reducing the chance of injury.

Referring to FIG. 2 user interface 6 is depicted is a straight rod shaped bar however, user interface 6 could take many forms, it could be a handle, a curved or bent bar, a flat padded surface, a curved or circular padded surface or any other piece capable of engaging a portion of the body. User interface 6 can move on a track such as one described in the co-pending applications or in free space. User interface 6 can be attached to any cable, pulley, chain, rope elastic band, flexible member based fitness machine by using an eyelet such as a clevis 3. A user can enter data into the user interface 6 using keypad sensor 15. Keypad sensor is coupled to microprocessor 11 and user data can be stored in microprocessor 11. The user can also enter data regarding which body part he/she will be using to move the user interface 6 and what type of motion or what exercise is desired. User recognition can also be done through other means such as a scrolling device or a fingerprint, voice, or other recognition system the user either pushes, pulls or twists on the user interface 6 or any combination thereof and a resulting force is supplied via the lead 20 to the resistance system 8.

Strain sensor 12 could be a micro electro mechanical system (MEMS) based device, a capacitance based device or any other technology which can measure the deflection or strain on a component or pull on lead 10. Strain sensor 12 could provide a very accurate measurement of the pulling or pushing force of the user on the user interface 6. Pulleys 42 and the cornering or bending of lead 10 around pulleys 42 can add to the force required to move the user interface 6. An accurate measurement of the force exerted by the user can be determined where lead 20 connects to user interface 6.

Sensor 14 may be a miniature motion based sensor such as an inertial measurement sensor or an angular rate sensor such as a gyro, a laser ring, a piezo or crystal-based sensor such as a thin film piezo-sensor, a global positioning sensor a MEMS gyro, a ring laser gyro, a fiber optic gyro, and accelerometer or a micro-machined vibrating beam sensor. Sensor 14 can measure movement or motion as well as torsion, acceleration and velocity of the user interface. The data can be sent to transmitter 11 and the data can then be sent to computer 60. Using stored motion data the computer 60 can display the path of the user interface 6 and the forces exerted on the user interface 6. A sensor such as an accelerometer could be utilized to measure the percentage of fast twitch and slow twitch muscle fibers utilized during an exercise. Correspondingly, computer 60 could suggest a routine for developing each type of muscle fiber or specific muscles. Sensors 16 and 17 can contact the exercisers skin and detect the users condition. Through skin of the user sensors 16 and 17 can detect human parameters such as body heat, pulse and grip strength.

User input could be provided an data could be displayed in touch sensitive LCD 19 could receive user input and display data during exercise. Three dimensional force vectors and six degrees of measurements can be determined using the sensor data. Combining the sensor data in the user interface 6 with sensor data from the users body from ultrasound, magnetic resonance imaging or X rays, complex nerve and muscle activity can be analyzed. The force vectors and muscle and nerve data can be utilized to provide data for diagnosing problems, or detecting injuries and to monitor recovery or responses to the therapy. Performance data can be stored by the computer 60 by processing position, force and velocity of a body part in complex motion and comparing the motion to a predetermined pattern. Computer 60 can provide real time instruction to the user such the user can correct the motions during the exercise to conform the desired motion. Sensor data can also be used to analyze current performance and suggest changes in motion, exercise routines or strength conditioning that can increase performance, mobility or flexibility, and reduce the possibility of injury, recovery from injury or surgery and to test maximum strength or acceleration, in any given position location or direction. Computer 50 can provide model training motions and feedback to the exerciser as to the motion to be used by the exerciser. It may be desirable for the exerciser to place a reference sensor 19 on his torso or at the base of a body appendage to be exercised to give computer 60 a reference position such that the relational motion of the body appendage can be determined. A motion switch 21 can be placed in the user interface 6 and the sensors can be off until motion switch 21 detects motion and powers up the sensors 12-18 and the transmitter 58. Sensors 12-18 can record position, force, deformation and velocity in relation to the center of gravity, torso or joint of the user. The user interface 6 can be a "basket shape" such as that user interface found in the co-pending applications.

Figure 3:
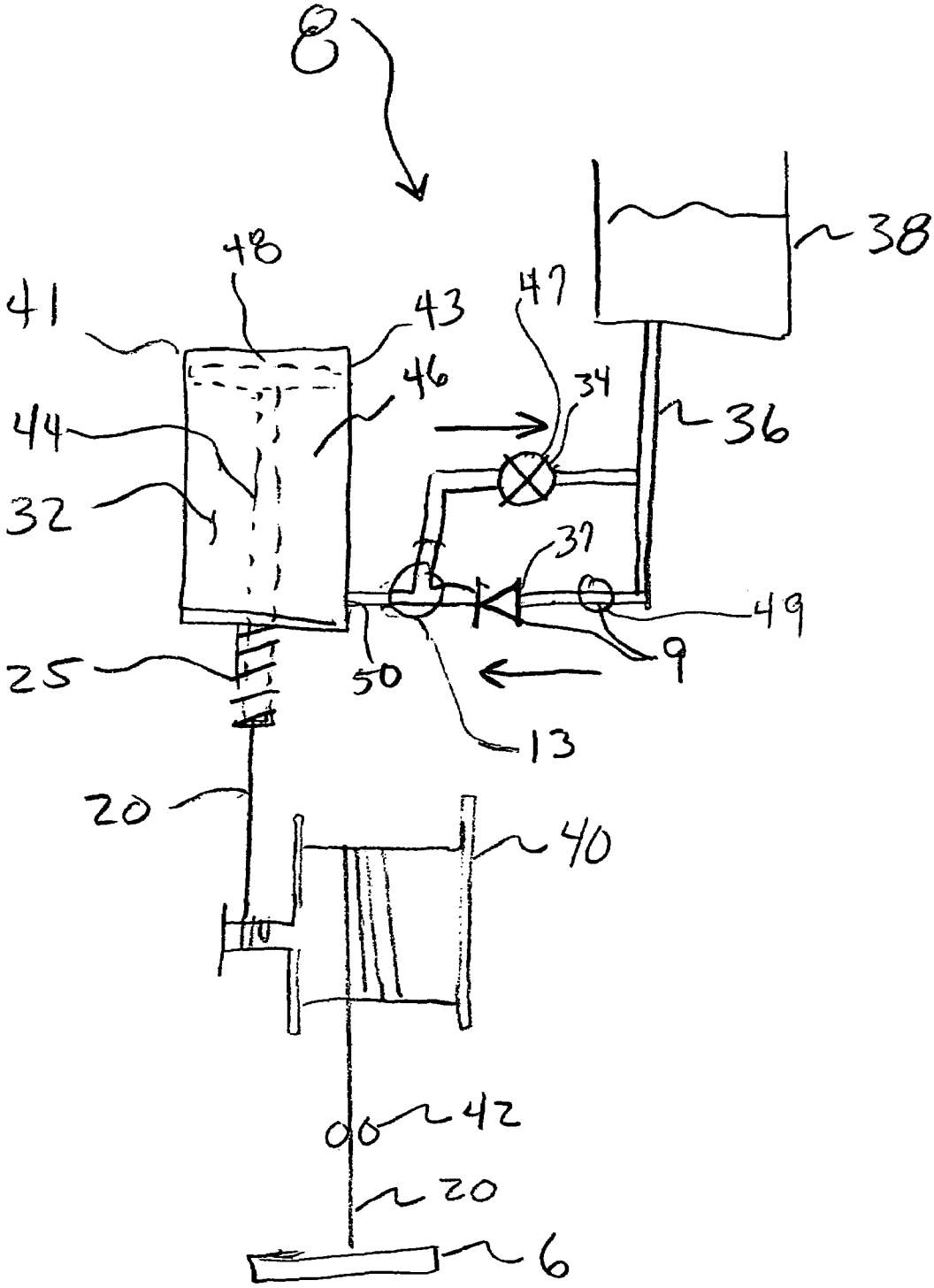
FIG. 3 illustrates a resistance system for providing a controlled resistance and controlled damping which can respond to sensor inputs.

Referring to FIG. 3 a resistance system 8 is depicted. Resistance system 8 can be comprised of a cylinder 43, first valve 34, conduit 36 reservoir 38, and other components such as gear reduction 40 and pulleys 42. Cylinder 43 has a bore 32 formed by outer casing 43 which surrounds a piston 44 and an elastic member 25 for returning piston 44 to a rest position Check valve 37 and throttle valve 34 are coupled to the port 50 and to reservoir 38. As the user interface 6 is moved from a rest position and lead 20 moves piston 44, the fluid coming out of port 50 seats the check valve 37 or one way valve and fluid flows through the throttling valve 34. An orifice in the throttling valve 34 can be adjusted to increase or decrease flow thus adjusting the resistance provided to the users movements via user interface 6. As throttle valve 34 is adjustably closed it takes more force for the user to move the user interface 6. When the exerciser has moved the user interface 6 from the rest position to the pinnacle of the motion and is returning towards the rest position, an elastic device such as spring 25 pulls the piston 44 (and the lead 20) back towards the fully retracted position or the rest position. When piston 44 moves from the pinnacle towards the rest position, a low pressure area is created in the chamber 32, second valve 37 or check valve opens and fluid is pulled from overflow tank 38 into cylinder bore 32. Damper valve 9 adjusts the damping or return speed of the user interface 6 in a controlled, damped manner. This can be particularly important in exercise involving portions of the body such as the neck where a snapping motion of a spring or banging and crashing of weights is undesirable. Sensor 13 and 14 can be coupled to resistance system 8 and to computer 50 and detect parameters such as fluid flow and pressure of the fluid and transmit data to computer 50.

Lead 20 may feed through a fairlead (not shown) and/or around a pulley 42 or series of pulleys 42 to provide the user with a "gear reduction" or mechanical advantage over the hydraulic system. This reduces the user force that needs to be exerted to overcome seal friction or to overcome static stiction forces. Concentric spools 40 can provide such gear reduction. Gear reduction allows the cylinder 43 to have a short stroke) and compact and a small movement of the user interface 6 moves a substantial amount of fluid without moving piston 44 a large distance. The resistance system 8 could also include a friction device or a brake mechanism that engages a brake (not shown). Damping can also be achieved when the rotational velocity of a sprocket becomes too high using a brake which is activated by centrifugal force. An added feature is to have a closed reservoir 38 and trap air in the reservoir 38 when piston 44 forces fluid into the reservoir 38 air compresses in reservoir 38 thus providing greater resistance to the users movements. An expandable air bladder (not shown) could also be used within reservoir to change the response of the resistance system 8. Air bladders are well known art for providing pressure within tanks or reservoirs.

The damping valve 9 can be effectively used to prevent injuries wherein when the exercise motion being performed places a joint in an awkward position the forces can be controlled reducing the exercisers vulnerability to injury. Free weights such as barbells do not work well for this application for they can become too heavy in certain positions and pull the user into an awkward position tearing muscles, tendons or ligaments causing injury. Specifically, irregular movements of a joint, or movement of body appendages to positions that are weak due to damaged tissue and other phenomena can be monitored using the present invention.

First valve 34 can be equipped with first actuator 47 computer 60 can control the position of first valve 36 the control system can vary the load during exercise as the user becomes fatigued. The amount of resistance provided by the resistance system 8 could be varied by a switch on the user interface 6, thus the user could vary the resistance using a simple push button on the handgrip of the user interface and the computer would change the position of the valves 34. A control system run by computer 60 could provide a safety feature and control the resistance. A variable load can also eliminate the need to "drop the weights." When a users force lessens the resulting force from the resistance system 8 can be lessened or removed.

Resistance system 8 may use two chambers first chamber 46 and second chamber 48 for providing resistance. Both of these chambers will vary in size (exactly opposite) as the piston 44 moves within the bore 32. Multiple cylinder ports can be used by the present invention to control resistance and damping to a users movement.

The foregoing is a detailed description of preferred embodiments of the invention. Various modifications and additions can be made without departing from the spirit and scope of the invention. Accordingly, this description is only meant to be taken by way of example and not to otherwise limit the scope of the invention.

The invention claimed is:

1. A system comprising:

a user interface to engage a portion of a user's body, the user interface configured to move in three dimensional space;

a resistance system coupled to the user interface, the resistance system to provide a user selectable resistance to movement of the user interface;

a lead coupled to the user interface and the resistance system, wherein the lead, in tension, to convey a user force from the user interface to the resistance system;

at least one sensor component located proximate to the user interface to detect at least one change occurring at the user interface, the at least change resulting from user input to the user interface, the at least one sensor component to assist in creating an output signal representative of the at least one change, the at least one sensor component to move with the user interface in three dimensional space and a processing system to receive the sensor output over a time interval, to process the sensor output and to transmit the processed sensor data over a network.

2. The system as in claim 1 further comprising a wireless transmitter coupled to the at least one sensor, the wireless transmitter to transmit the output signal of the sensor component.

3. The system as in claim 1, wherein the at least one sensor component detects movement in three dimensions.

4. The system as in claim 1, wherein the user interface has a coupler to couple the sensor component to the user interface such that the sensor component can be decoupled from user interface and connected to another user interface.

5. The system as in claim 1, wherein the at least one sensor component comprises at least a portion of a position sensing system such that a position of the user interface can be determined in the three dimensional space.

6. The system as in claim 1, further comprising an input device to receive a second input where the second input is an identifier that can be utilized to uniquely identify the user.

7. The system as in claim 1, further comprising a sensor to identify a user in proximity of the user interface.

8. The system as in claim 2, further comprising a motion activated switch to activate the wireless transmitter.

9. The system as in claim 1, wherein the at least one sensor component is coupled between the lead and the user interface.

10. The system of claim 1 wherein the three dimensional space comprises locations defined by a three dimensional accurate surface and movement of the user interface is substantially confined to points along the three dimensional accurate surface.

11. The system as in claim 1, wherein the at least one sensor component comprises a sensor to detect a distance moved by the user interface.

12. The system as in claim 1, wherein the at least one sensor component comprises a sensor to detect an acceleration of the user interface.

13. The system as in claim 1, wherein the at least one sensor component comprises a sensor to provide information usable to detect a range of motion of the user interface.

14. The system as in claim 1, wherein the at least one sensor component comprises a sensor to detect a velocity of the user interface.

15. The system as in claim 1, further comprising a clock to provide a time parameter wherein the output provided by the at least one sensor component comprises data and the data to be associated with the time parameter.

16. The system as in claim 1, wherein the at least one sensor component comprises a sensor to identify an attribute of the user.

17. The system as in claim 1, wherein the at least one sensor component comprises a sensor to uniquely identify a user and to transmit an activation signal to activate at least a portion of the system.

18. The system as in claim 1, wherein the at least one sensor component is one of a micro electro mechanical system (MEMS), an inertial measurement sensor, an angular rate sensor, a gyroscopic sensor, a ring laser sensor, a piezo sensor, a crystal based sensor, a thin film piezo sensor, a vibrating beam sensor, a global positioning sensor, a fiber optic sensor or a micro-machined vibrating sensor.

19. The system as in claim 1, further comprises one of a magnetic resonance imaging machine, an X-ray machine or an ultra-sound machine to generate data related to movement of the sensor component.

20. A system comprising:

a user interface to engage a portion of a user's body, the user interface configured to move in three dimensional space;

a resistance system coupled to the user interface, the resistance system to provide a user selectable resistance to movement of the user interface;

a lead coupled to the user interface and the resistance system, wherein the lead, in tension, to convey a user force from the user interface to the resistance system;

at least one sensor component located proximate to the user interface to detect at least one change occurring at the user interface, the at least change resulting from user input to the user interface, the at least one sensor component to assist in creating an output signal representative of the at least one change, the at least one sensor component to move with the user interface in three dimensional space; and a wireless transmitter coupled to the at least one sensor, the wireless transmitter to transmit the output signal of the sensor component.

21. The system of claim 20 further comprising a wireless transmitter coupled to the at least one sensor, the wireless transmitter to transmit the output signal of the sensor to the processing system.

22. The system of claim 20, wherein the at least one sensor component detects; at least one of movement in one of at least three dimensions, a position, a user, the identity of a user, the location of a users appendage, an attribute of the user, an acceleration of the user interface, a velocity of the user interface, a range of motion of the user interface, distance moved by the user interface, movement and sends a corresponding activation signal.

23. The system as in claim 20, further comprising a motion activated switch to activate the wireless transmitter.

24. The system as in claim 20, further comprising a clock to provide a time parameter wherein the output provided by the at least one sensor component comprises data and the data to be associated with the time parameter.

25. The system as in claim 20, wherein the at least one sensor component is one of a micro electro mechanical system (MEMS), an inertial measurement sensor, an angular rate sensor, a gyroscopic sensor, a ring laser sensor, a piezo sensor, a crystal based sensor, a thin film piezo sensor, a vibrating beam sensor, a global positioning sensor, a fiber optic sensor or a micro-machined vibrating sensor.

26. The system as in claim 20, further comprises one of a magnetic resonance imaging machine, an X-ray machine or an ultra-sound machine to generate data related to movement of the sensor component.

27. A system comprising:

a user interface to engage a portion of a user's body, the user interface configured to move in three dimensional space;

a resistance system coupled to the user interface, the resistance system to provide a user selectable resistance to movement of the user interface;

a lead coupled to the user interface and the resistance system, wherein the lead, in tension, to convey a user force from the user interface to the resistance system;

at least one sensor component located proximate to the user interface to detect at least one change occurring at the user interface, the at least change resulting from user input to the user interface, the at least one sensor component to assist in creating an output signal representative of the at least one change, the at least one sensor component to move with the user interface in three dimensional space wherein the three dimensional space comprises locations defined by a three dimensional accurate surface and movement of the user interface is substantially confined to locations about the three dimensional accurate surface.

28. The system of claim 27, wherein the at least one sensor component detects; at least one of movement in one of at least three dimensions, a position, a user, the identity of a user, the location of a users appendage, an attribute of the user, an acceleration of the user interface, a velocity of the user interface, a range of motion of the user interface, distance moved by the user interface, movement and sends a corresponding activation signal.

29. The system as in claim 27, further comprising a clock to provide a time parameter wherein the output provided by the at least one sensor component comprises data and the data to be associated with the time parameter.

30. The system as in claim 27 wherein the at least one sensor component is one of a micro electro mechanical system (MEMS), an inertial measurement sensor, an angular rate sensor, a gyroscopic sensor, a ring laser sensor, a piezo sensor, a crystal based sensor, a thin film piezo sensor, a vibrating beam sensor, a global positioning sensor, a fiber optic sensor or a micro-machined vibrating sensor.

31. The system as in claim 27, further comprises one of a magnetic resonance imaging machine, an X-ray machine or an ultra-sound machine to generate data related to movement of the sensor component.

* * * * *